United States Patent [19]

Phillips

[11] 4,025,994

[45] May 31, 1977

[54] DIFFERENTIALLY DRAFTED LOFTED CONTINUOUS FILAMENT YARN AND PROCESS FOR MAKING SAME

[75] Inventor: Bobby M. Phillips, Kingsport, Tenn.

[73] Assignee: Eastman Kodak Company, Rochester, N.Y.

[22] Filed: July 29, 1976

[21] Appl. No.: 709,681

Related U.S. Application Data

[63] Continuation-in-part of Ser. No. 616,744, Sept. 25, 1975, abandoned.

[52] U.S. Cl. ..... 28/72.12; 57/157 F; 57/157 S

[51] Int. Cl.[2] ..... D02G 1/16

[58] Field of Search ..... 57/34 B, 157 F, 157 S, 57/157 MS; 28/1.4, 72.12

[56] References Cited

UNITED STATES PATENTS

| | | | |
|---|---|---|---|
| 2,924,868 | 2/1960 | Dyer | 57/34 B X |
| 3,303,169 | 2/1967 | Pitzl | 57/157 F |
| 3,453,709 | 7/1969 | Dyer | 57/34 B X |
| 3,473,315 | 10/1969 | Le Noir | 57/157 F X |
| 3,534,453 | 10/1970 | Lefebure | 28/72.12 |
| 3,898,719 | 8/1975 | Lloyd | 28/72.12 X |

*Primary Examiner*—Richard C. Queisser
*Assistant Examiner*—Charles Gorenstein
*Attorney, Agent, or Firm*—D. B. Reece, III; Malcolm G. Dunn

[57] ABSTRACT

Process and product obtained by the process by which an undrawn or partially drawn continuous filament yarn is heated above glass transition temperature and is differentially drafted by co-current and countercurrent heated gaseous flows to form in the filaments at random intervals along the lengths of the individual filaments coils, loops or whorls, with more drafting occurring in those portions of the filaments having the coils, loops or whorls than the other portions, and with more drafting occurring in some loops than others, and at the same time heat setting the yarn within the heated gaseous flows.

5 Claims, 2 Drawing Figures

DIFFERENTIALLY DRAFTED LOFTED CONTINUOUS FILAMENT YARN AND PROCESS FOR MAKING SAME

BACKGROUND OF THE INVENTION

This invention is directed to a draw-lofting process for man-made yarns and particularly to polyester continuous filament yarns and fabrics including such yarns.

Previous lofted yarn products have been made using fully processed continuous filament yarns which are overfed to a high-pressure air jet device. Those products can be made with a single-end overfeed or with dual-end feed. In the case of polyester yarn, for instance, drafting may have been accomplished either on a draw-twister or on a continuous spin draw type apparatus.

U.S. Pat. No. 2,852,906 to Breen, for example, is representative of the prior art by which a bulky continuous filament yarn is achieved by passing a bundle of continuous filaments through a high velocity air jet in which the individual filaments are caused to become separated and whipped about sufficiently to form coils, loops or whorls at random intervals along their lengths. The various irregularly spaced convolutions in the yarn provide a lateral interfilament spacing important in producing the bulk and resulting garment warmth of fabrics made from such yarn.

As explained in an earlier Breen, U.S. Pat. No. 2,783,609, the "loops" indicated refers to tiny complete loops formed by a filament doubling back upon itself, crossing itself and then proceeding in substantially the original direction. In mathematics, a curve of this type is said to have a crunode; thus the term "crunodal loops" was derived by the patentee to distinguish in his specification those loops from other forms of loops. The patentee explained that the majority of loops visible on the surface of the yarn of his invention were of a roughly circular or ring-like shape. The crunodal loops inside of the yarn were not readily studied but that it was evident that the pressure of surrounding filaments would tend to cause such loops to assume more complex shapes. Breen reported that the most obvious characteristics of his continuous filament yarn were its bulkiness and the presence of a multitude of filament ring-like loops irregularly spaced along its surface.

The Breen patents explain that a stream of air or other compressible fluid is jetted rapidly from a confined space to form a turbulent region in which yarn passing therethrough is supported by the fluid stream and the individual filaments are separated from each other and whipped about violently in the turbulent region. As the separated filaments are removed from the turbulent region, they are swirled into convolutions which may be held in place by adjacent filaments of the reforming yarn bundle. The resulting bulkiness of the yarn may be stabilized by an additional treatment such as by twisting the filaments together, thereby increasing the friction between filaments to hold the convolutions more firmly in place. The yarn may then be wound up for subsequent processing.

As shown by the numerous examples in the Breen patents, and as explained on page 549 in the text, "Man-Made Fibers" (4th Edition -1963) by R. W. Moncrieff, Publisher: Heywood & Company Limited in London, England, the yarn is fed through an air jet to take-up rollers which draw off the yarn at a speed lower than the speed at which it is fed to the jet. Since the take-up speed is slower than the feed speed, the air-jet forms numerous randomly spaced loops, thereby taking up the slack in the filaments produced by the overfeed. As also explained in the text, the process does not depend on the thermoplasticity of the fiber and thus can be applied to any continuous multi-filament yarn, such as viscose rayon. The Breen patents also give as examples nylon (polyhexamethylene adipamide), glass, polyethylene terephthalate, cellulose acetate, acrylic and vinyl chloride-acrylonitrile copolymer yarns.

In still another Breen U.S. Pat. No. 2,869,967, it is pointed out that the amount of "overfeed," which characterizes the difference between yarn feed and yarn take-up or wind-up, is one of the factors that controls the amount of bulking action accomplished in the air jet and shown generally be in the range of 5% to 50%, depending upon the effect desired.

The above-described operation is to be contrasted with the process disclosed in this invention wherein the yarn is fed to a gaseous jet device at one speed and is taken up from the gaseous jet device at a greater speed due to the drafting operation that occurs within the jet device. The process is not only further distinguished from the prior art in that the gases within the jet device are heated so as to raise the temperature of the yarn above the glass transition temperature and with the induced drag forces cause the drafting of the yarn to occur, but also that the drafting is a nonuniform or differential drafting resulting in the formation at random intervals along each of the filaments of coils, loops or whorls. The coils, loops or whorls in each filament are held in place by similar formations in adjacent filaments when the filaments recombine to form a single yarn bundle upon leaving the gaseous jet device. The yarn bundle has also been stabilized by having been heat set while within the gaseous jet device.

SUMMARY OF THE INVENTION

An object of this invention, therefore, is to provide a process by which undrawn or partially drawn (i.e., partially oriented) continuous filament yarn is heated above glass transition temperature and is differentially drafted by co-current and countercurrent heated gaseous flows to form in the filaments coils, loops or whorls at random intervals along the lengths of the individual filaments, with more drafting occurring in those portions of the filaments having the coils, loops or whorls then the other portions, and with more drafting occurring in some loops than others, and at the same time heat setting the yarn within the heated gaseous flows. The loops also include "crunodal loops" as described above.

Another object of this invention is to provide from an undrawn or partially drawn (i.e., partially oriented) continuous filament yarn a lofted yarn product having filaments with differentially drafted portions with the resulting formed coils, loops or whorls, which are spaced at random intervals along the individual filament lengths essentially constituting the greater drafted portions of the yarn product.

Still another object of the invention is to provide a fabric which includes as components of the fabric continuous filament yarns having filaments with differentially drafted coils, loops or whorls formed at random intervals along the lengths of the individual filaments of the yarn. The fabric may be woven or non-woven, or may be knitted, and may include other types of yarn or fiber components.

The process, and the product which is obtained by the process, are achieved by feeding from a source of supply to and through a jet device having co-current and counter-current heated gaseous flows a single end of undrawn or partially drawn filament yarn; heating the filament yarn while in the jet device to a predetermined temperature above the glass transition temperature by the co-current and counter-current gaseous flows; differentially drafting the filament yarn in the jet device by drag forces induced by the heated co-current and counter-current gaseous flows and thereby form in the filaments at random intervals along the lengths of the individual filaments, coils, loops or whorls in those portions of the yarn that are drafted more than other portions; heat setting the yarn in the jet device; and taking up the yarn from the air jet device at speeds and tensions insufficient to remove such coils, loops or whorls. Differential drafting also occurs among the coil, loops or whorls with some being more drafted than others.

Drafting occurs in the jet because once the yarn has been raised to a temperature above its glass transition temperature, the tensions on the yarn caused by the high speed turbulent stream are sufficient to induce elongations in the yarn. It is thought that the differential drafting occurs because of the variability in induced tension across the flow channel. In plotting a velocity profile across the flow channel of the gaseous jet device, the maximum or greatest drag inducing force will occur at the center of the velocity profile, i.e., at the center of the flow channel, while the least drag inducing force will occur at the interior wall surface of the flow channel. In the turbulence which occurs within the jet device, the filaments of the yarn strand or bundle will become separated from each other and will be whipped violently about. Those filaments wihin the center of the flow channel of the jet device will tend to have the greatest induced drag forces imposed thereon with a resulting greater loop or coil or whorl being formed. Those filaments near the interior wal surface will tend to have the least drag forces imposed thereon with a resulting smaller loop or coil or whorl being formed. The filaments, however, will not stay solely within the center or solely next to the wall, so that the overall combination of drag forces including collisions with other filaments or looping portions of filaments will bring about the final end result, which is a non-uniform drafting or differential drafting of the filaments and of the loops in the filaments.

The co-current and counter-current gaseous flows, preferably air flows, are heated to temperatures greater than glass transition temperature, and the speed of the co-current and counter-current air flows is preferably greater than 50% of sonic velocity. The co-current and counter-current flows may range from essentially 0–100% co-current and 100–0% counter-current with the sum total of the two flows being 100%. The preferred flows are essentially 75% co-current and 25% counter-current. It should be recognized, however, that the take-up speed of the yarn is dependent upon the temperature of the gaseous flow and its velocity so as to achieve heating of the yarn above glass transition temperature.

The filament yarn is taken up from the air jet device at a greater speed than its speed at being fed into the air jet device due to the drafting operation taking place in the jet device.

One of the advantages of this yarn product over lofted yarn of the type produced from the practice of the Breen disclosures is that boiling water shrinkage will be about zero percent since the yarn has been dimensionally stabilized by crystallization due to being heat set at a temperature above the boiling point of water in an essentially relaxed condition. On the other hand, the boiling water shrinkage for the prior art lofted yarn is generally about five to seven percent.

Another advantage, as to a yarn product made from thermoplastic materials such as from polyester, is that "picking" propensity in a fabric containing the yarn product of this invention will be reduced. The reason for this is thought to be that the process tends to weaken the yarn and allow it to break more readily, whereas in a fabric made from the lofted yarn of the type shown in the Breen disclosures made from fully oriented yarn, a "picked" filament can cause distortion of a large section of the fabric before the filament finally breaks.

One of the problems presented by use of polyester continuous filament yarn, or use of any other high, break resistant thermoplastic yarn, for that matter, in conventional air lofting processes of the prior art has to do with the difficulty resulting from the attempt to withdraw the yarn from a package on which the yarn has been wound. The coils, loops or whorls protruding from the surface of one yarn strand tend to become interlocked with those of the contiguous yarn strands. Since polyester continuous filament yarn, for instance, is so much stronger than cellulose acetate continuous filament yarn, the filaments of one polyester yarn strand so interlocked will, upon attempt to withdraw from the yarn package, pick and pull out other filaments from the contiguous yarn strands and thereby tend to destroy the integrity of the yarn strands and make uniform withdrawal difficult. This situation is also true of a fabric made from polyester continuous filament lofted yarn when the fabric is doubled or folded against itself and then attempt is made to unfold it. This problem does not arise with cellulose acetate continuous filament conventional lofted yarn since the weaker cellulose acetate filaments will break more readily and will not pick or become tenaciously adhered to the filaments in the contiguous yarn strands.

Still another advantage, therefore, of a yarn product made from thermoplastic materials, such as polyester, in the practice of the disclosed process is that the differential drafting obtained will tend to weaken the loopy portions of the yarn and cause them to break more readily when attempt is made to separate one yarn strand from another, or to separate one part of a fabric containing this yarn from another part of the fabric or from another fabric.

One of the advantages of the process of this invention is that it is more economical to practice the process since drafting and heat setting of the yarn product occur in a single step or within a single device. Unlike the Breen patented disclosures in which the yarn was drafted and oriented before passing the yarn through the lofting jet, such prior drafting is not necessary as in the instance of using an undrafted yarn, and it is also not necessary to steam the yarn after the lofting step in order to impart a permanent set, as proposed, for example, by Breen in U.S. Pat. No. 2,783,609.

Another advantage of the process of this invention over the lofting processes disclosed in the prior art such as represented by the Breen patents is that it has the potential for greater speed through the gaseous jet device since the speed of the prior art processes is limited by the turbulence conditions and the slack conditions in the turbulence zone within the jet device. The process of this invention is only limited by the residence time and the heat transfer conditions within the jet sufficient to raise the yarn to above the glass transition temperature in order to enable the induced drag forces to differentially draft the yarn.

Other advantages will be apparent to those skilled in the art to which this invention pertains.

PREFERRED EMBODIMENT OF THE INVENTION

Figure 2:
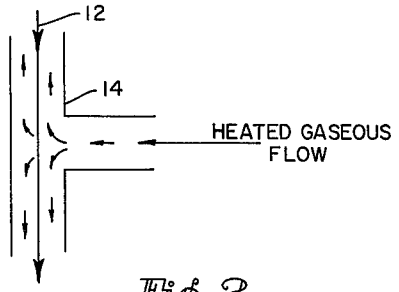
FIG. 2 is a diagrammatic illustration of the co-current and counter-current gaseous flows within the gaseous jet device.
Figure 1:
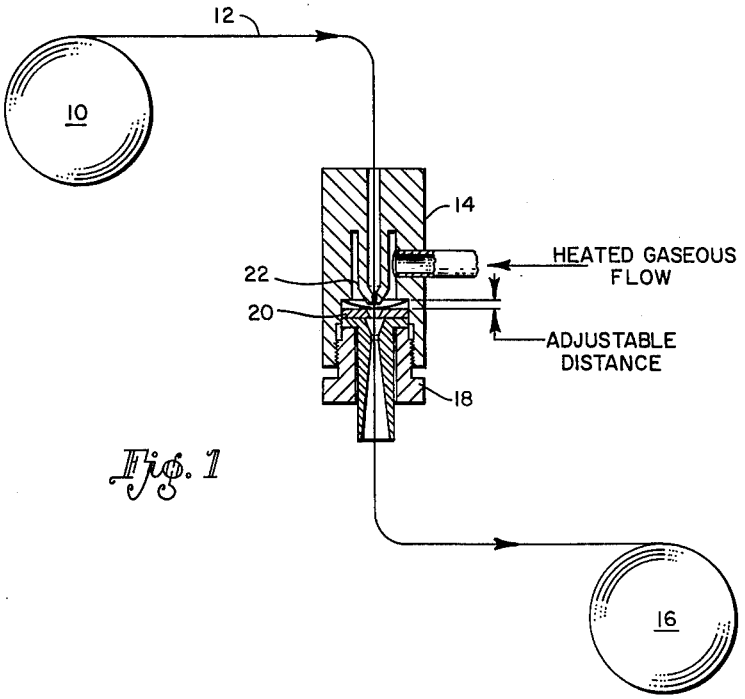
FIG. 1 is a simple schematic illustration of a multifilament yarn source, typical gaseous jet device and a yarn take-up device.

In reference to FIG. 1 of the drawings, 10 designates a source of supply of an end of multifilament yarn 12, which may be undrawn, or partially drawn or otherwise termed "partially oriented yarn." The reference numeral 14 designates a conventional yarn lofting device constructed similarly to that disclosed in the Dyer, U.S. Pat. No. 2,924,868 which is preferably T-shaped, although not necessarily limited to T-shaped, so that the yarn passes to and through the jet device along one generally straight-line path while a source of heated air or other suitable heated gas intersects the yarn at essentially right angles to flow both co-current and counter-current to the direction of the yarn travel, as shown in FIG. 2.

As will be recognized by those skilled in the art, the conventional lofting or jet device 14 may be adjusted by means of the threaded plug 18 to determine the desired percentage of co-current and counter-current air flows. The movement of the threaded plug toward or away from the orifice plate 20 causes the distance between the nozzle or nozzle tip 22 and the orifice plate 20 to be varied or adjusted. For instance, the following table illustrates the consequence of a few of such adjustments.

TABLE

| *Counter-Current | % Co-Current | Distance Between Nozzle and Orifice Plate |
|---|---|---|
| 0 p.s.i.g. | 100% | .051 inch |
| 4 p.s.i.g. | about 80% | .055 inch |
| 8 p.s.i.g. | about 60% | .059 inch |
| 12 p.s.i.g. | about 40% | .076 inch |

*From a system having a maximum air pressure of 20 p.s.i.g.

The invention is not limited to the use of the particular jet device shown in the drawing or in the Dyer patent since obviously other jet device constructions may be used. The Dyer jet device as illustrated, however, may be inverted so that the yarn enters what was previously the yarn outlet end, as shown, in order to obtain a 0% co-current flow and a 100% counter-current flow. The nozzle opening may also be enlarged. All of this discussion is only to establish that the jet device per se is not the invention, but rather the overall concept of how applicant's invention is accomplished. The co-current and counter-current gaseous flows or heated air flows set up a turbulent region in which the individual filaments of the yarn are raised to above the glass transition temperature and are caused to become separated, locally drafted, and whipped about sufficiently to form in the filaments coils, loops or whorls at random intervals along the lengths of the individual filaments. The yarn take-up device is shown simply at 16, which may be any conventional yarn wind-up apparatus.

The heated co-current and counter-current air flows induce drag forces on the continuous filament yarn passing through the jet device to cause the differential drafting. At the same time, the heated air flows serve to heat set the yarn.

The process involves the use of an undrawn or partially drawn or oriented feeder yarn, such as of a polyester yarn from poly(ethylene terephthalate) polymer, which is fed to a jet device in which the heated gaseous flows, such as air, heat the feeder yarn to above the glass transition temperature of the particular yarn concerned. With respect to polyester yarn from poly(ethylene terephthalate) polymer, it is preferred that the temperature should be above 80° C., which is slightly above its glass transition temperature.

The amount of drafting and lofting which takes place is determined by the design of the jet itself, velocity, pressures and temperature of the air in the jet and the yarn velocity through the jet, and the extent to which the yarn may have been previously drafted. The range of air pressures extend from about 30 p.s.i.g. to about 500 p.s.i.g.; the range of air temperatures may extend from slightly above the glass transition of a particular material up to about 250° C., the temperature being limited by the material of the jet device; the range of heat setting temperatures may extend from about 130° C. up to about 250° C.; and the take-up speed of the yarn from the gaseous jet device may extend up to around 1000 meters per minute. The heat setting temperature depends upon the temperature necessary to bring about dimensional stabilization of the desired material by crystallization. The particular speeds, temperatures, residence time in the jet device and the like are dependent, of course, on whatever is necessary to raise a particular material above its glass transition temperature. If it should also be desired that the yarn be heat set while in the jet device, then the temperatures, speeds employed, and the like must be such as to stablize the yarn, particularly if it is desired that the product have a boiling water shrinkage of about zero percent.

The invention is applicable to any thermoplastic yarn capable of being drafted in heated gaseous flows or air flows. Other compressible fluids or gases may be employed as desired.

This invention can be further illustrated by the following examples of preferred embodiments thereof, although it will be understood that these examples are included merely for purposes of illustration and are not intended to limit the scope of the invention unless otherwise specifically indicated.

EXAMPLE 1

The feed yarn was 570 denier/100 filaments undrawn poly(ethylene terephthalate).

| | |
|---|---|
| Air pressure | 28 lbs./in.$^2$ |
| Air temperature | 175° C. |

-continued

| | |
|---|---|
| Feed rate | 50 ft./min. |
| Take-up rate | 135 ft./min. |

Physical properties of the differentially drafted lofted yarn were:

| | |
|---|---|
| Denier | 213 |
| Tenacity | 1.90 g./den. |
| Elongation | 13% |
| Elastic Modulus | 10.2 g./den. |
| Boiling water shrinkage | 0% |
| Specific volume | 2.22 cubic centimeters/gram at a tension of 0.1 gram/denier |

This yarn exhibited a bulky loopy character, which was similar to previous lofted yarns produced from fully drawn feed yarns.

EXAMPLE 2

Similar to Example 1 except the air temperature was 200° C. Physical properties of the lofted yarn were:

| | |
|---|---|
| Denier | 204 |
| Tenacity | 1.06 g./den. |
| Elastic Modulus | 66 g./den. |
| Elongation | 46% |
| Boiling water shrinkage | 0% |
| Specific volume | 2.60 cubic centimeters/gram at a tension of 0.1 gram/denier |

This yarn also exhibited a bulky loopy character.

The products made by this process are useful for making bulky fabrics which have a uniquely desirable hand.

EXAMPLE 3

The feed yarn was 540 denier/100 filaments undrawn poly(ethylene terephthalate).

| | |
|---|---|
| Air pressure | 34 lbs./in.$^2$ |
| Air temperature | 150° C. |
| Feed rate | 50 ft./min. |
| Take-up rate | 120 ft./min. |

Physical properties of the differentially drafted lofted yarn were:

| | |
|---|---|
| Denier | 247 |
| Tenacity | 1.59 g./den. |
| Elongation | 83% |
| Elastic modulus | 17 g./den. |
| Boiling water shrinkage | 0% |
| Specific volume | 2.50 cubic centimeters/gram at a tension of 0.1 gram/denier |

This yarn also exhibited a bulky loopy character.

A small length of yarn was cut from the processed yarn product of Example 3, and as many filaments as could be readily picked from the yarn bundle without breakage or undue stretching were taped at their distal ends to a glass slide. The glass slide was inserted below a microscope and the diameter of each of the filaments were measured at the same point along the length of each filament. The table below shows the measurements that were made on 27 of the filaments from the yarn bundle and illustrate by the differences in the measurements the differential drafting that has taken place.

TABLE

| Filament No. | | Diameter Microns |
|---|---|---|
| 1 | | 19.19 |
| 2 | | 13.81 |
| 3 | | 12.62 |
| 4 | | 16.12 |
| 5 | | 13.56 |
| 6 | | 12.70 |
| 7 | | 11.94 |
| 8 | | 11.43 |
| 9 | | 12.02 |
| 10 | | 13.64 |
| 11 | | 12.88 |
| 12 | | 12.11 |
| 13 | | 11.60 |
| 14 | | 12.79 |
| 15 | | 12.96 |
| 16 | | 14.07 |
| 17 | | 15.26 |
| 18 | | 14.15 |
| 19 | | 14.50 |
| 20 | | 12.19 |
| 21 | | 15.09 |
| 22 | | 13.56 |
| 23 | | 11.08 |
| 24 | | 14.41 |
| 25 | | 19.02 |
| 26 | | 11.17 |
| 27 | | 14.67 |
| | Average = | 13.65 |
| | Std. Dev. | 2.045 |

The specific volume given in the examples above is a bulk yarn test which is conducted in the following manner:

An aluminum cylinder, which has a diameter of 3 inches, has an annular groove machined within its surface around the circumference of the cylinder. The slot is ⅛ inch wide and ½ inch deep. The volume of the annular groove equals 8.044 cubic centimeters. The yarn to be tested is wound under a specified tension of 0.1 gram per denier within the annular groove until the yarn fills the annular groove and is level with respect to the surfaces of the cylinder adjacent the groove. The wound yarn is then cut and removed from the annular groove and weighed in grams. The specific volume in cubic centimeters per gram is equal to the volume of the annular groove in the cylinder or 8.044 cubic centimeters divided by the weight in grams of the yarn removed from the cylinder.

Non-textured, round cross-sectioned, fully drafted poly(ethylene terephthalate) filament yarn generally has a specific volume of about 1.00 cubic centimeters per gram by this bulk test.

The invention has been described in detail with particular reference to preferred embodiments thereof, but it will be understood that variations and modifications can be effected within the spirit and scope of the invention.

I claim:

1. Process for producing a draw-lofted yarn, the process comprising:

feeding from a source of supply to and through a gaseous jet device having co-current and countercurrent gaseous flows a single end of undrawn or partially drawn continuous filament yarn.

heating the filament yarn while in the jet device to a predetermined temperature above the glass transition temperature by the co-current and countercurrent gaseous flows, differentially drafting the filmant yarn in the jet device by drag forces induced by the heated co-current and counter-current gaseous flows and thereby form in the filaments at random intervals along the lengths of the individual filaments coils, loops or whorls in those portions of the yarn that are drafted more than the other portions so differentially drafted, the co-current and counter-current gaseous flows ranging from essentially 0–100% of total flow co-current and 100–0% of total flow counter-current with the sum total of the two flows being 100%, and taking up the yarn from the gaseous jet device at speeds and tensions insufficient to remove the loops.

2. Process as defined in claim 1, and further comprising heat setting the yarn in the gaseous jet device.

3. Process as defined in claim 1, wherein the filament yarn is poly(ethylene terephthalate) and is heated in the gaseous jet device to temperatures greater than 80° C.

4. Process as defined in claim 3, wherein the speed of the co-current and counter-current gaseous flows in the gaseous jet device is greater than 50% of sonic velocity.

5. Process as defined in claim 1, wherein the filament yarn is taken up from the gaseous jet device at a greater speed than its speed at which it is being fed into the gaseous jet device.

* * * * *